US006040544A

United States Patent [19]

Schantz et al.

[11] Patent Number: 6,040,544

[45] Date of Patent: Mar. 21, 2000

[54] OPTOELECTRONIC SEPARATION APPARATUS

[75] Inventors: Matthäus Schantz, Rēut; Franz Köppl, Erlbach; Dirk Flottmann, Altötting, all of Germany

[73] Assignee: Wacker-Chemie GmbH, Munich, Germany

[21] Appl. No.: 09/075,033

[22] Filed: May 8, 1998

[30] Foreign Application Priority Data

May 9, 1997 [DE] Germany ..... 197 19 698

[51] Int. Cl.[7] ..... B07C 5/00

[52] U.S. Cl. ..... 209/577; 209/576; 209/588

[58] Field of Search ..... 209/588, 577, 209/587, 589, 247, 231, 938, 939, 639, 644

[56] References Cited

U.S. PATENT DOCUMENTS

| | | | |
|---|---|---|---|
| 4,143,770 | 3/1979 | Grimmell et al. | 209/577 |
| 4,624,367 | 11/1986 | Shafer et al. | 209/577 |
| 4,699,273 | 10/1987 | Suggi-Liverani et al. | 209/587 |
| 5,165,548 | 11/1992 | Dumler et al. . | |
| 5,518,124 | 5/1996 | Sommer, Jr. et al. | 209/577 |

FOREIGN PATENT DOCUMENTS

| | | | |
|---|---|---|---|
| 0358627 | 9/1989 | European Pat. Off. . | |
| 4113093 | 10/1991 | Germany . | |
| 4321261 | 2/1994 | Germany . | |
| 404073932A | 3/1992 | Japan | H01L 21/265 |
| 2142426A | 1/1985 | United Kingdom | G01N 2/47 |

OTHER PUBLICATIONS

For DE 4321261 an English Derwent Abstract is enclosed.

*Primary Examiner*—Donald P. Walsh
*Assistant Examiner*—Daniel K Schlak
*Attorney, Agent, or Firm*—Collard & Roe, P.C.

[57] ABSTRACT

An apparatus for the optoelectronic classification of semiconductor materials, has a separating device 2 and a slide face 3, the angle of the slide face 3 to the horizontal being adjustable, and the separating device 2 and the slide face 3 each having a surface made of the semiconductor material to be separated. There is a radiation source 5, through the beam path of which the material to be classified falls, and a shape recognition device 6, which transmits the shape of the material to be classified to a control unit 7, which controls at least one diverter device 8.

7 Claims, 1 Drawing Sheet

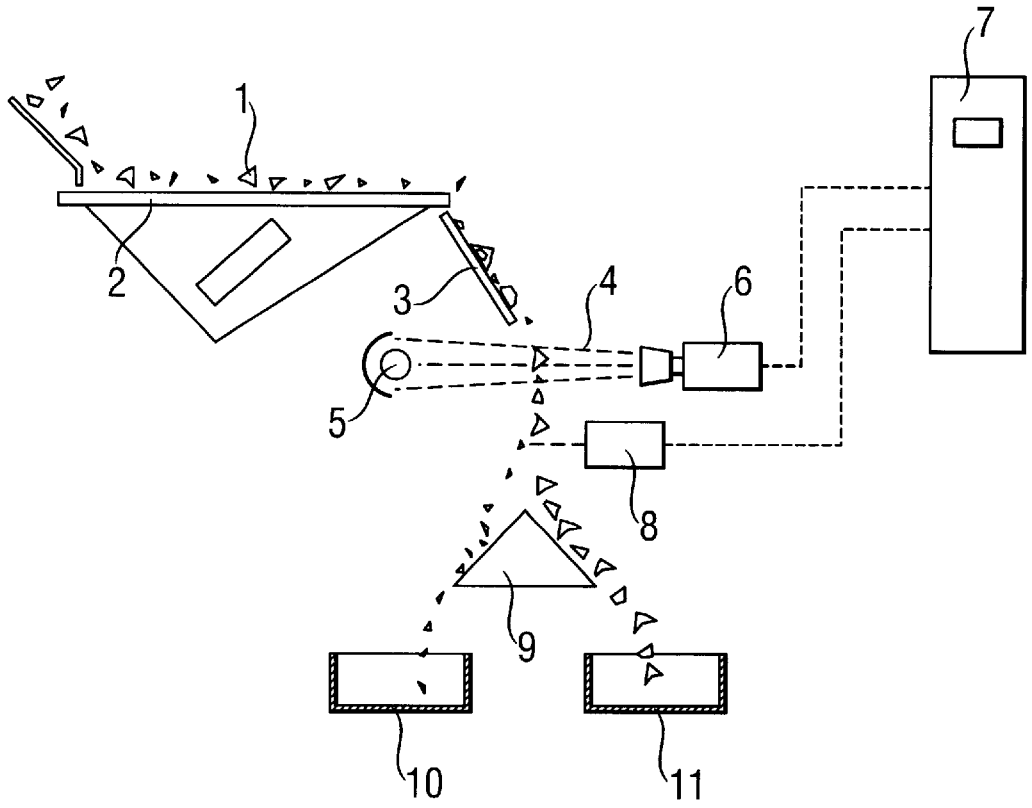
1
2
3
4
5
6
7
8
9
10
11

OPTOELECTRONIC SEPARATION APPARATUS

BACKGROUND OF THE INVENTION

1. Field of the Invention

The present invention relates to an apparatus and a method for the optoelectronic classification and separation of semiconductor material.

2. The Prior Art

High-purity semiconductor material is required for the production of solar cells or electronic components, such as for example storage elements or microprocessors. The dopants introduced in a targeted manner are the only impurities which, in the most favorable case, a material of this kind should contain. It is therefore desirable to keep the concentration of harmful impurities as low as possible. It is frequently observed that even semiconductor material which has been produced to a high level of purity is recontaminated during further processing to give the desired products. For this reason, complex cleaning steps are required again and again in order to regain the original level of purity. Atoms of foreign metals which become incorporated into the crystal lattice of the semiconductor material can interfere with the charge distribution. These atoms can reduce the performance of the ultimate component or lead to its failure. Consequently, contamination of the semiconductor material resulting in particular from metallic impurities is to be avoided. This applies in particular to silicon, which is the most frequently used semiconductor material in the electronics industry. High-purity silicon is obtained, for example, by the thermal decomposition of silicon compounds which are highly volatile, and are therefore easy to purify using a distillation method, such as for example trichlorosilane. In this case, the silicon is obtained in the form of polycrystalline rods with typical diameters of from 70 to 300 mm and lengths of from 500 to 2500 mm. A large proportion of the rods are used to produce crucible-pulled monocrystals, strips or sheets, or to produce polycrystalline solar-cell base material. Since these products are made from high-purity, molten silicon, it is necessary to melt solid silicon in crucibles. In order for this operation to be as efficient as possible, large-volume, solid silicon pieces, such as for example the abovementioned polycrystalline rods, have to be comminuted prior to melting. This generally entails surface contamination of the semiconductor material, since the comminution is carried out using metallic crushing tools, such as jaw or rolling crushers, hammers or chisels.

According to the usual comminution methods for semiconductor materials using mechanical tools, such as crushers or hammers, the semiconductor material is present in various fragment sizes. For process engineering reasons, numerous semiconductor materials, such as primarily polysilicon, have to be present in a specific fragment size distribution for the melting operation. Since it is not permissible for any impurities to pass into the crucible together with the semiconductor material, very particular demands have to be placed on both the crushing process and on the classification process, so that there is no contamination from atoms of foreign material emanating from metallic tools, such as for example screening apparatus. This fact precludes conventional screening apparatus which are commercially available. When screening on, for example, a vibrating screen made of metal, the hard, sharp-edged silicon fragment leads to a high level of abrasion of the screen bottom and therefore to unacceptable contamination of the silicon surface, requiring the use of complex purifying methods. Therefore, screen bottoms made of silicon are used. However, the high risk of the silicon components breaking entails a high outlay on refitting. A further drawback of screening methods is the high risk of the screen becoming blocked, due to the irregular grain shape of the silicon fragments.

For these reasons, the use of screen-free separating methods, such as fluid separation and classification, was investigated. Since the required cut-off points lie in the range of centimeters, gas-separation and classification is ruled out. This is because the high air velocities required for this purpose, combined with the sharp-edged material to be screened, cause a high level of abrasion to the equipment. Fluid separation in water exhibits this drawback only to a limited extent. However, in this case the irregular grain shape of the silicon fragment leads to a very imprecise cut-off point. This is because, for example, leaf-shaped silicon fragments are suspended in the fine material due to their low sinking rate, even though their geometric dimensions mean that they belong to a coarser grain class. Moreover, in this wet classification and separation method, continuous delivery of material is very difficult.

Thus all the classification and separation methods which have been described above exhibit significant drawbacks, since they either contaminate the material to be screened, tend to cause a blockage or have an insufficiently accurate cut-off point.

SUMMARY OF THE INVENTION

It is an object of the present invention to provide an apparatus and a method by which the drawbacks of the prior art are avoided. In particular an apparatus and a method are provided for the separation and classification of semiconductor material, in particular of silicon, in which the semiconductor material is contaminated with metal atoms to the lowest possible degree. A suitably accurate cut-off point can be set, and as little abrasion as possible will result. Also there are no holes which can become blocked. The present invention achieves these unexpected results which are surprisingly unique in view of the prior art.

BRIEF DESCRIPTION OF THE DRAWINGS

Other objects and features of the present invention will become apparent from the following detailed description considered in connection with the accompanying drawing which discloses one embodiment of the present invention. It should be understood, however, that the drawing is designed for the purpose of illustration only and not as a definition of the limits of the invention.

In the drawing, the FIGURE shows an apparatus according to the invention.

DETAILED DESCRIPTION OF PREFERRED EMBODIMENTS

Turning now in detail to the drawing, the FIGURE shows an apparatus for the optoelectronic classification and separation of semiconductor materials, wherein the apparatus has a separating device 2 and a slide face 3. The angle of the slide face 3 is adjustable to the horizontal. The separating device 2 and the slide face 3 each have a surface made of the semiconductor material to be classified, and a radiation source 5, through the beam path 4 of which the material to be classified falls. A shape recognition device 6 transmits the shape of the material to be classified to a control unit 7, which controls at least one diverter device 8.

The apparatus is preferably used to classify hard, brittle semiconductor materials, such as silicon, germanium or gallium arsenide according to grain size. It is preferably used to classify and separate silicon. This apparatus can also be used to separate semiconductor material into two or more grain-size fractions.

The apparatus is designed in such a way that the material 1 to be classified and separated firstly passes onto a device for separating and preferably for simultaneously conveying, which is preferably a vibrating conveyor. This vibrating conveyor is preferably subjected to vibrations which separate the fragments of semiconductor material and convey them in the direction of the slide face 3. However, it is also possible to place the material on a conveyor in a ready-separated form. The angle of this slide face 3 is adjustable with respect to the horizontal; it is set as a function of the coefficient of friction between fragment and surface covering in such a manner that the fragments preferably slide downward under the action of the force of gravity. The angle is set within a range from 20° to 80°, preferably 30° to 70°.

This device 2 for separating and preferably for conveying, and the slide face 3, are designed in such a way that the semiconductor material to be classified does not come into contact, on their surfaces, with materials other than the semiconductor material to be classified. This is preferably carried out by coating this device 2 for separating and preferably for conveying and the slide face 3 with the same semiconductor material as that which is to be classified. The separating device 2 and the slide face 3 may also be made entirely from the appropriate semiconductor material. Therefore, in the case of silicon, this means that they may be coated with silicon or consist of silicon. On the slide face, the pieces of material align themselves in such a manner that their center of gravity comes to lie at as low a level as possible. This means that during their free fall after passing over the slide face 3, their largest projection surface faces the radiation source 5. The height of the fall between the slide face 3 and the diverter device 8 is preferably 5 cm to 20 cm, particularly 10 cm.

A radiation source 5 and a shape recognition device 6 are arranged approximately in the center of this falling distance, the piece of material moving between the radiation source 5 and the shape recognition device 6. The distance between the piece of material and the radiation source 5 is preferably 50 cm to 120 cm, particularly preferably 70 cm. The distance between the piece of material and the shape recognition device 6 is preferably 5 cm to 12 cm, particularly preferably 6 cm. The radiation source 5 is preferably an electromagnetic radiation source, such as a laser, or a lamp which emits visible light in the range from 400 nm to 700 nm. It is also possible to emit electromagnetic radiation in the infrared range, in the ultraviolet range or in the X-ray range. The shape recognition device 6 is preferably a high-resolution sensor, which may be a camera, for detecting visible light, infrared rays, ultraviolet rays or X-rays.

This sensor is connected to a control unit 7, which evaluates the data received. This control unit 7 is preferably a computer. This control unit 7 controls at least one diverter device 8 using a predetermined program. In this case, this recognition system, comprising control unit 7 and shape recognition device 6, can detect a specific grain size or a grain-size range. The diverter device 8, which captures the appropriate grain size or a grain-size range, is preferably a nozzle from which, preferably, gases or liquids can be ejected. The gases preferably are air or inert gases, such as nitrogen, which can be ejected at a pressure of above atmospheric pressure, preferably at 3 to 10 bar, particularly preferably at 6 bar. In the case of the liquids, preferably high-purity water, having a conductance of preferably below 0.14 uS, particularly preferably of 0.08 uS, is ejected at a pressure of preferably 2 to 20 bar.

In a particular embodiment, a piece of material which is too large is subjected to comminution using a water jet at preferably 1500 bar to 5000 bar, particularly preferably at 3500 bar. The diverter device 8 may be arranged on its own or may comprise a plurality of nozzles which are arranged next to one another. These nozzles are preferably arranged in a series at intervals of preferably 3 to 15 mm, particularly preferably of 9 mm, when the pieces of material fall in parallel through the beam path 4 of the radiation source 5.

The diverted pieces of material of the desired grain size or grain-size range are preferably collected in a collection container 10 via a separating device 9. The pieces of material which have not been diverted are collected in a collection container 11. At least on the inside, the collection containers may have a surface made of the semiconductor material to be classified, or the containers may consist of this material. The two separated streams of material can be divided into further grain classes by means of further recognition systems and diverter devices. It is likewise possible to carry out classification in accordance with surface parameters. The provision of further separating devices 9 would also enable material to be separated into a plurality of grain classes. In this case the falling path is divided up by diversion effects of different strengths, preferably by air blasts of different strengths. This separating device 9 is preferably provided on the surface with the semiconductor material to be classified, or consists of this material.

The present invention is also directed to a method for the optoelectronic classification and separation of semiconductor materials by means of the apparatus according to the invention for optoelectronic classification and separation. The material to be classified is separated on a separating device 2, which has the semiconductor material to be classified on its surface, and slides downward over a slide face 3. Slide face 3 has the semiconductor material to be classified on its surface. The angle of the slide face is adjustable to the horizontal by an adjustment means, so that the center of gravity of the material to be classified and separated lies as low as possible. This material, after leaving the slide face 3 in this alignment passes through the beam path of a radiation source 5. A shape recognition device 6 transmits the shape of the material to be classified to a control unit 7. This control unit in accordance with preset criteria controls at least one diverter device 8 which diverts the material to be classified.

In a preferred method embodiment according to the invention, the comminuted material 1, in this case semiconductor material, is conveyed in a separating device 2 toward a slide face 3. The angle of the slide face 3 is adjusted, as a function of the coefficient of friction between the semiconductor material to be classified and separated and the surface coating. This adjustment is made in such a manner that the semiconductor material to be separated slides downward, preferably under the force of gravity. In the process, the irregularly shaped semiconductor material aligns itself in such a manner that its center of gravity comes to lie at as low a level as possible. In other words, the material has its largest projection surface facing toward the slide face 3. Aligned in this way, the comminuted material, after leaving the slide face 3, moves past the recognition system, which comprises radiation source 5 and shape recognition device 6. The material moves past the beam path 4 of the radiation source 5, and is detected by a shape recognition device 6. Device 6 preferably has an optical resolution of 0.1 mm to 20 mm, and particularly preferably has an optical resolution of 0.5 mm to 10 mm, the data obtained being evaluated by a control unit 7. The semiconductor material to be classified moves past the recognition system over a falling period of 0.05 sec to 1 sec, particularly preferably from 0.1 sec to 0.2 sec. Depending on the deflection caused by the measured longitudinal extent or projection surface of the semiconductor material to be classified with respect to the set separating criterion, at least one diverter device 8 is activated. This device 8 diverts, for example, all the semiconductor material pieces which are too small using, for example, an air jet, thus deflecting them out of their original falling path. A separating device 9 separates the two fractions, which are collected in separate collection containers 10 and 11.

The method according to the invention, in combination with the apparatus according to the invention, has the advantages that classification and separation is carried out without contamination. Preferably, a range of from 15 mm to 150 mm is classified and separated in a continuously variable manner. However, it can also be set in such a way that a range of, for example, 10 to 20 mm is captured or a specific percentage of a certain grain size is captured, mixed with a percentage of another specific grain size. In this way, it is possible to set adjustable loading charges precisely as desired by the purchasers, who need specific grain-size distributions in order to fill the crucible from which, for example, the monocrystal is to be pulled.

Other objects and features of the present invention will become apparent from the following Example, which disclose an embodiment of the present invention. It should be understood, however, that the Example is designed for the purpose of illustration only and not as a definition of the limits of the invention.

EXAMPLE

A preferred embodiment of the apparatus according to the invention for optoelectronic classification and separation has an operating width of, for example, 500 mm, an optical resolution of 0.5 mm and a nozzle array arranged at a spacing of 8 mm, classifying a volumetric flow of 1 t/h from a pile of polysilicon fragments of different sizes with a grain separation size of 30 mm and a sharp cut-off point.

While several embodiments of the present invention have been shown and described, it is to be understood that many changes and modifications may be made thereunto without departing from the spirit and scope of the invention as defined in the appended claims.

What is claimed is:

1. An apparatus for the optoelectronic classification and separation of semiconductor material comprising:

a separating device (2);

a slide face (3) adjacent to said separating device, and means for adjusting the angle of the slide face (3) to the horizontal so that a center of gravity of the material to be separated is as low as possible;

said separating device (2) and said slide face (3) each having a surface made of the semiconductor material to be separated;

a radiation source (5) producing a beam path (4), and said semiconductor material to be separated falling through said beam path (4) so that the largest projection surface of the material during the falling faces the radiation source;

a shape recognition device (6) for transmitting a shape of the semiconductor material to be separated to a control unit (7); and at least one diverter device (8) being controlled by said controller unit (7) for diverting and separating said semiconductor material.

2. The apparatus as claimed in claim 1, wherein said means for adjusting causes the angle of the slide face 3 to be 20° to 80° to the horizontal.

3. The apparatus as claimed in claim 1, wherein the surface of the separating device (2) and of the slide face (3) is silicon.

4. A method for the optoelectronic classification and separation of semiconductor material comprising:

separating the material to be classified on a separating device (2) having a surface, said surface having thereon the semiconductor material to be separated;

said material sliding downward over a slide face (3) having a slide surface which has the semiconductor material to be separated on said slide surface;

adjusting an angle of the slide face (3) to the horizontal so that a center of gravity of the material to be separated is as low as possible;

said material after leaving the slide face (3), falling through a beam path (4) of a radiation source (5) so that the largest projection surface of the material during the falling faces that radiation source;

a shape recognition device (6) transmitting a shape of the material to be separated to a control unit (7);

said control unit (7) controlling at least one diverter device (8); and said diverter device (8) separating by diverting the material to be separated.

5. The method for the optoelectronic classification and separation of semiconductor materials as claimed in claim 4, comprising setting the angle of the slide face within a range from 20° to 80° to the horizontal.

6. The method for the optoelectronic classification and separation of semiconductor materials as claimed in claim 4, wherein the semiconductor material to be separated is silicon.

7. The method for the optoelectronic classification and separation of semiconductor materials as claimed in claim 4, comprising additionally comminuting semiconductor material which is too large using a water jet.

* * * * *